US006688042B2

(12) United States Patent
Stojc et al.

(10) Patent No.: US 6,688,042 B2
(45) Date of Patent: Feb. 10, 2004

(54) CENTRAL LOCK MECHANISM

(75) Inventors: Andre Stojc, Quebec (CA); Philip J. Calamatas, Quebec (CA)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 0 days.

(21) Appl. No.: 10/135,501

(22) Filed: Apr. 30, 2002

(65) Prior Publication Data

US 2002/0194784 A1 Dec. 26, 2002

Related U.S. Application Data

(60) Provisional application No. 60/288,778, filed on May 5, 2001.

(51) Int. Cl.[7] ..... E05C 7/06
(52) U.S. Cl. ..... 49/118
(58) Field of Search ..... 49/116, 117, 118, 49/122, 280, 360, 361, 363

(56) References Cited

U.S. PATENT DOCUMENTS 4,087,939 A * 5/1978 Elguindy et al. ..... 49/118
5,755,060 A * 5/1998 Zweili ..... 49/449
6,009,668 A * 1/2000 Reddy ..... 49/280
6,032,416 A * 3/2000 Springer et al. ..... 49/118
6,094,867 A * 8/2000 Reddy ..... 49/280
6,134,838 A * 10/2000 Reddy ..... 49/362
6,189,265 B1 * 2/2001 Fink ..... 49/118
6,446,389 B1 * 9/2002 Heffner et al. ..... 49/280

* cited by examiner

*Primary Examiner*—Jerry Redman
(74) *Attorney, Agent, or Firm*—James Ray & Associates

(57) ABSTRACT

A lock mechanism enabling locking of a bi-parting set of right hand and left hand door panels respectively suspended from a right hand and left hand door operators, to be driven by the door operators for covering and uncovering an aperture disposed within a passenger transit vehicle. Such lock mechanism disposed intermediate the door operators. The lock mechanism is capable of operating in a pushback and non pushback arrangement providing a fully-locked state, for each of the two bi-parting doors of a passenger transit vehicle. The integrated design allows the central lock mechanism to be installed and/or maintained over a doorway with only minimal adjustments needed to assure that the door lock assemblies operate in unison. As compared to separate door lock assemblies for each door panel as is typical of prior art designs, the central lock mechanism enables the door panels to be closed and locked more reliably and with better sealing against weather and noise.

14 Claims, 8 Drawing Sheets

FIG. 5A
PRIOR ART
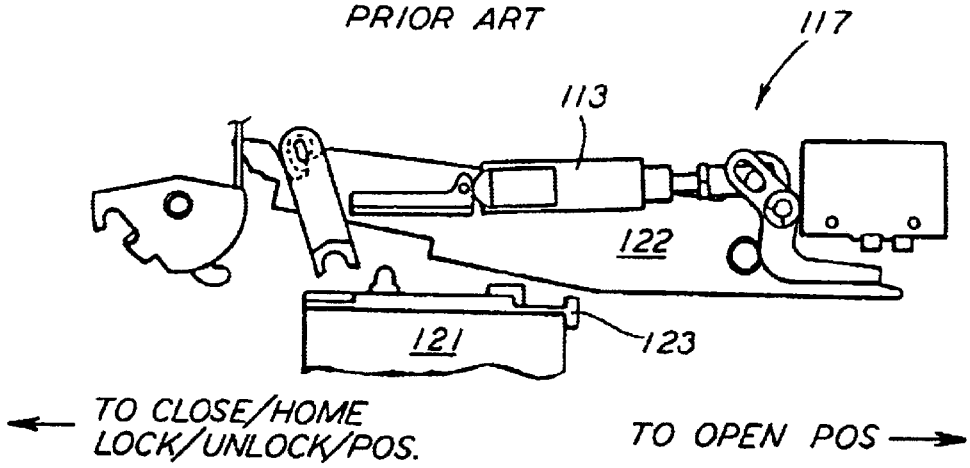
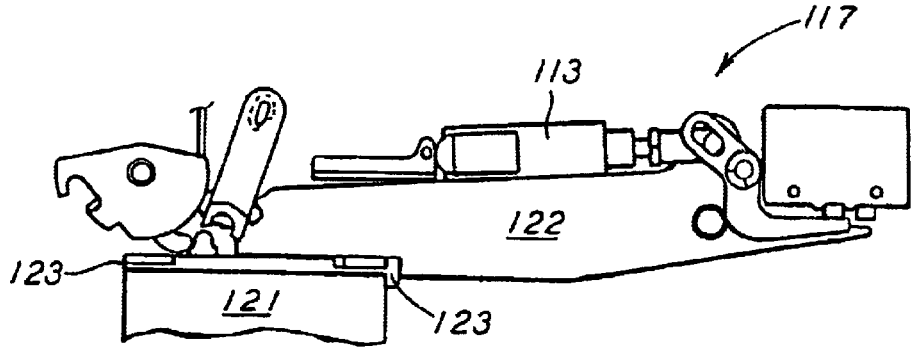
FIG. 5B
PRIOR ART
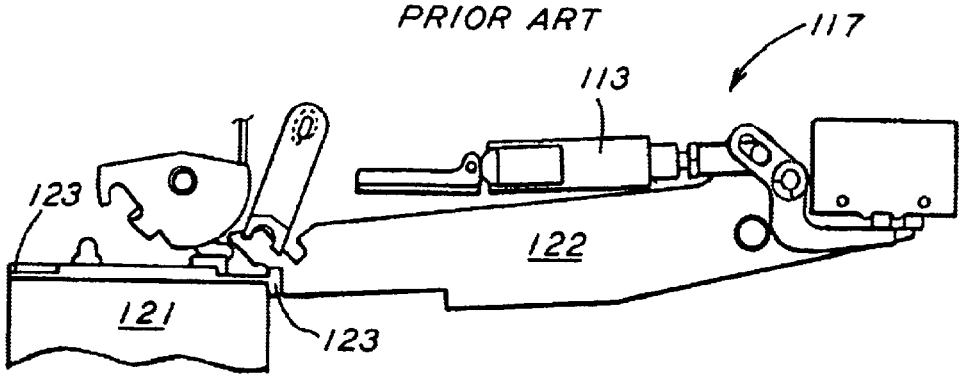
FIG. 5C
PRIOR ART

CENTRAL LOCK MECHANISM

CROSS-REFERENCE TO RELATED APPLICATIONS

This application is related to and claims priority from U.S. provisional Patent Application Serial No. 60/288,778 filed on May 5, 2001, Titled "Two Motor Arrangement For A Door Operator" filed concurrently herewith. This application is also related to the invention disclosed in U.S. Pat. No. 6,032,416, titled "Transit Vehicle Door". The teachings of U.S. Pat. No. 6,032,416 and co-pending utility application Ser. No. 10/135,642 and filed concurrently herewith are incorporated into this document by reference thereto.

FIELD OF THE INVENTION

The invention generally relates to door hardware systems of the type typically used to operate a pair of bi-parting doors of a passenger transit vehicle. More particularly, the invention pertains to a central lock mechanism enabling locking of two door panels in either pushback or non-pushback.

BACKGROUND OF THE INVENTION

The following background information is provided to assist the reader to understand the environment in which the invention will typically be used. The terms used herein are not intended to be limited to any particular narrow interpretation unless specifically stated otherwise in this document.

It is generally well known in the passenger transit vehicle art to employ a powered door operator having a locking mechanism for locking a door panel attached to the powered door operator and driven thereby to cover and uncover an aperture in the passenger transit vehicle. Among the many door operators to which the invention disclosed herein relates is the door hardware system disclosed in the text and figures of U.S. Pat. No. 6,032,416. FIG. 1 shows an opening in a sidewall of a railcar. Fixed to, or incorporated as part of the body of, the railcar above the aperture is a base plate disposed just above and horizontally along the length of opening. It is to this base plate that the door hardware system attaches to such railcar.

Regarding the locking feature of the door hardware system of the prior art, each outer door hanger has a contact bracket (not shown) attached to the top of its upper section. Atop the outer door hanger, a contact bracket (not shown) is designed to cooperate with a first door lock assembly to provide a lock for a door panel. Similarly, a second door lock assembly cooperates with a contact bracket (not shown), atop another outer door hanger to provided a lock for a second door panel. The first and second door lock assemblies are also mirror-symmetrical devices.

For this reason, the parts of the second door lock assembly are not described in detail for the sake of brevity. Reference can also be had to the figures of U.S. Pat. No. 6,032,416. As shown in FIGS. 4A–C, the first door lock assembly includes a lock member, a pivot pin, an unlock actuator, a pushback member, a latch lever, an emergency release rotor, a full lock switch and a pushback lock switch.

As shown in FIGS. 5A–C, the second door lock assembly includes a lock member and an unlock actuator. The pushback member, latch lever, emergency release rotor, full lock switch and pushback lock switch of assembly are shown, but not numerically denoted for brevity. Being door status switches, the full and pushback lock switches can be deployed with their first contacts providing input to a door controller (not shown).

Referring again to FIGS. 4A–C illustrating the first door lock assembly, the latch lever is pivotally connected at its upper end to the body of the assembly at a point above the right end of lock member. Latch lever has a cam (shown in dotted lines) on the other end of its pivot pin. Located at the lower end of this lever is the latch itself. The full lock switch is positioned behind the pushback lock switch, with both being secured to the body of the lock assembly. Pushback member is pivotally connected to the body, just to the right of pushback lock switch. The unlock actuator has its right end secured to the body of the assembly. The actuator has a push rod extending from its left end. The leftmost end of push rod connects by a pin to the upper left end of lock member and within the channel joint of the pushback member.

Pivotable about a pin, the lock member features lock step, a pushback step, a cam receptor slot and a lock arm formed as a part of its leftmost end. The cam receptor slot is formed in the top side of lock member near its right end and pushback step is formed on the bottom side of the lock member near its middle. Such lock step is formed in the lower right end of the lock member.

The lock members are disposed within first and second door lock assemblies, respectively, so as to be normally biased in the downward state. For the first door lock assembly, this is best shown in FIG. 4C. For the second door lock assembly, it is best shown in FIG. 5C. Specifically, starting with FIG. 2 with further reference to FIG. 4A, as the first door is being moved rightward towards the CLOSE POSITION by the motor and drive mechanism, the contact bracket, atop the outer door hanger, eventually slides left to right underneath the bottom side of the lock member.

As outer door hanger and door therewith continue rightward, the protuberance of the contact bracket encounters the left side of the lower end of the latch causing such latch to rotate counterclockwise. This counterclockwise rotation causes the cam of such latch to rotate out of engagement with the cam receptor slot of the lock member. With its right end being disengaged from the cam, the lock member then pivots clockwise about a pin so that its right end falls on top of the bracket. As the outer door hanger and door therewith close to within approximately 40 mm. of the CLOSE POSITION, the leftmost corner of the bracket is first caught by a pushback step due to the downward bias of the lock member, as shown in FIG. 4B. This causes the pushback member to pivot clockwise and engage the button of the pushback lock switch. With its two contacts closed, the switch closes its portion of the DCLC trainline and provides a pushback-locked signal to a DCU to indicate that the pushback lock has engaged (i.e., member has assumed the pushback-locked state). As the motor and drive mechanism continue to close the doors, the leftmost corner of the contact bracket moves through the pushback region between steps and is eventually caught by a lock step, as shown in FIG. 4C. This causes the lock member to pivot clockwise further about the pin so that its leftwardly extending arm engages the button of the full lock switch. With its contact closed, the switch sends to a DCU a fully-locked signal indicating that the full lock has now engaged. It is in this manner that the lock member assumes the fully-locked state wherein the leftmost corner of the contact bracket abuts against the lock step thereby preventing the outer door hanger and the first door therewith from being re-opened.

Due to the linkage of the drive mechanism, the second door is moved leftward simultaneously with the rightward movement of the first door. Specifically, starting again with FIG. 2 with reference to FIG. 5A, as the second door is being moved leftward towards the CLOSE POSITION, a contact bracket atop an outer door hanger eventually slides right to left underneath the bottom side of a lock member. As the outer door hanger and the second door therewith continue leftward, the protuberance of the bracket encounters the right side of the lower end of the latch in assembly causing that latch to rotate clockwise. This clockwise rotation causes the cam of that latch to rotate out of engagement with the cam receptor slot of a lock member. With its left end being disengaged from the latch cam, the lock member then pivots counterclockwise about its pin so that its left end falls on top of the bracket.

As outer door hanger and the door therewith close to within approximately 40 mm. of the CLOSE POSITION, the rightmost corner of the contact bracket is first caught by the pushback step of the lock member due to the downward bias operating on it, as shown in FIG. 5B. This causes the pushback member of the assembly to pivot counterclockwise and engage the button of its corresponding pushback lock switch. With its two contacts closed, this switch closes its portion of the DCLC trainline and provides a pushback-locked signal to a DCU to indicate that the pushback lock of the lock member has engaged (i.e., member has assumed the pushback-locked state).

As the motor and drive mechanism continue to close the doors, the rightmost corner of the contact bracket moves through the pushback region between the steps of the lock member and is eventually caught by the lock step, as shown in FIG. 5C. This causes the lock member to pivot counterclockwise further about its pin so that its rightwardly extending arm engages the button of the full lock switch for assembly. With its contact closed, this switch sends to a DCU a fully-locked signal indicating that the full lock of such lock member has now engaged. It is in this manner that the lock member assumes the fully-locked state wherein its lock step serves as an abutment against the rightmost corner of the contact bracket thereby preventing the second door panel from being re-opened. Moreover, due to the linkage of the mechanism, whenever any one of the lock members is fully locked, both doors are prevented from opening.

The aforementioned door operator has separate door lock assemblies, as is typical of prior art door hardware systems. As FIG. 2 shows, the door lock assemblies are distinct components, each attached to the base plate at a distinct spot above, and on opposite sides of, the doorway. Recent experience has revealed, however, that the use of separate door lock assemblies has its disadvantages.

As alluded to above, the door panels are essentially coupled together mechanically through drive the mechanism and related componentry. The door lock assemblies must therefore operate essentially in unison as the door panels are moved to the OPEN and FULL LOCK POSITIONS. This requires each door lock assembly to be precisely positioned on the base plate so that it will assume the same state at the same time as its partner. For example, as the door panels are closing, the door lock assemblies should each assume the pushback-locked state and then the fully-locked state nearly simultaneously. If one or both are out of position, one door lock assembly may conceivably remain unlocked when the other has properly assumed the fully-locked state.

Additionally, the lock assemblies incorporate complex components requiring adjustments to transmit linear motion of the actuator into rotary motion of the lock member in order to lock and unlock the doors.

As heretofore designed, the door lock assemblies thus require relatively frequent adjustment to make sure that they operate in unison. It would therefore be desirable to develop a lock mechanism whose design addresses the shortcomings in the existing technology, one that requires only minimal adjustment and incorporates fewer components.

SUMMARY

The present invention teaches a lock mechanism enabling locking of a bi-parting set of right hand and left hand door panels respectively suspended from a right hand and left hand door operators, to be driven by such door operators for covering and uncovering an aperture disposed within a passenger transit vehicle, the lock mechanism is disposed intermediate such door operators. The lock mechanism is capable of operating in a pushback and non pushback arrangement providing a fully-locked state, for each of the two bi-parting doors of a passenger transit vehicle. The integrated design allows the central lock mechanism to be installed and/or maintained over a doorway with only minimal adjustments needed to assure that the door lock assemblies operate in unison. As compared to separate door lock assemblies for each door panel as is typical of prior art designs, the central lock mechanism enables the door panels to be closed and locked more reliably and with better sealing against weather and noise. Such lock mechanisms comprise a first and second block support assemblies having means for mounting to a passenger vehicle structure, a first and second lock member is rotatably disposed within the first and second block support assemblies, respectively. A mounting bracket is attached to the first and second block support assemblies and a plurality of rotary actuators are mounted to such mounting bracket. The rotary actuators engage the first and second lock members for moving such first and second lock members from a locking position into an unlocking position. A plurality of sensors are disposed within the lock mechanism for providing predetermined status signals when such first and second lock members are in such locking and pushback positions. A lever and cam arrangement are rotatably disposed within the first and second support block assemblies for manual unlocking of the door from the remote location via a flexible cable. A cover is provided to substantially shield such rotary actuator and sensors from access upon at least partial uncovering of such aperture.

OBJECTS OF THE INVENTION

It is, therefore, an one of the primary objects of the present invention to provide a central lock mechanism that is able to lock two doors within a single assembly, in lieu of the separate door lock assemblies typical of prior art designs.

Another object of the present invention is to provide a central door lock mechanism that requires only minimal adjustments to keep its door lock assemblies operating in unison.

Yet another object of the present invention is to provide a central door lock mechanism that has fewer components and is more tamperproof than its prior art predecessors.

A further object of the present invention is to provide a central lock mechanism whose door lock assemblies are capable of operating as a two-stage lock, i.e., providing pushback-locked and fully-locked states.

Yet a further object of the present invention is to provide a central lock mechanism whose door lock assemblies, when fully locked, enable the door panels when closed to provide better sealing against weather and noise than prior art door lock assemblies.

Still a further object of the present invention is to provide a central lock mechanism that provides a more reliable operation.

In addition to the objects and advantages listed above, various other objects and advantages of the invention will become more readily apparent to persons skilled in the relevant art from a reading of the detailed description section of this document. The other objects and advantages will become particularly apparent when the detailed description is considered along with the drawings and claims presented herein.

BRIEF DESCRIPTION OF THE DRAWINGS

FIGS. 5A–C are frontal views of the right door lock assembly of FIGS. 1–2 showing its lock member in the unlocked, pushback-locked and fully-locked states, respectively.

Figure 1:
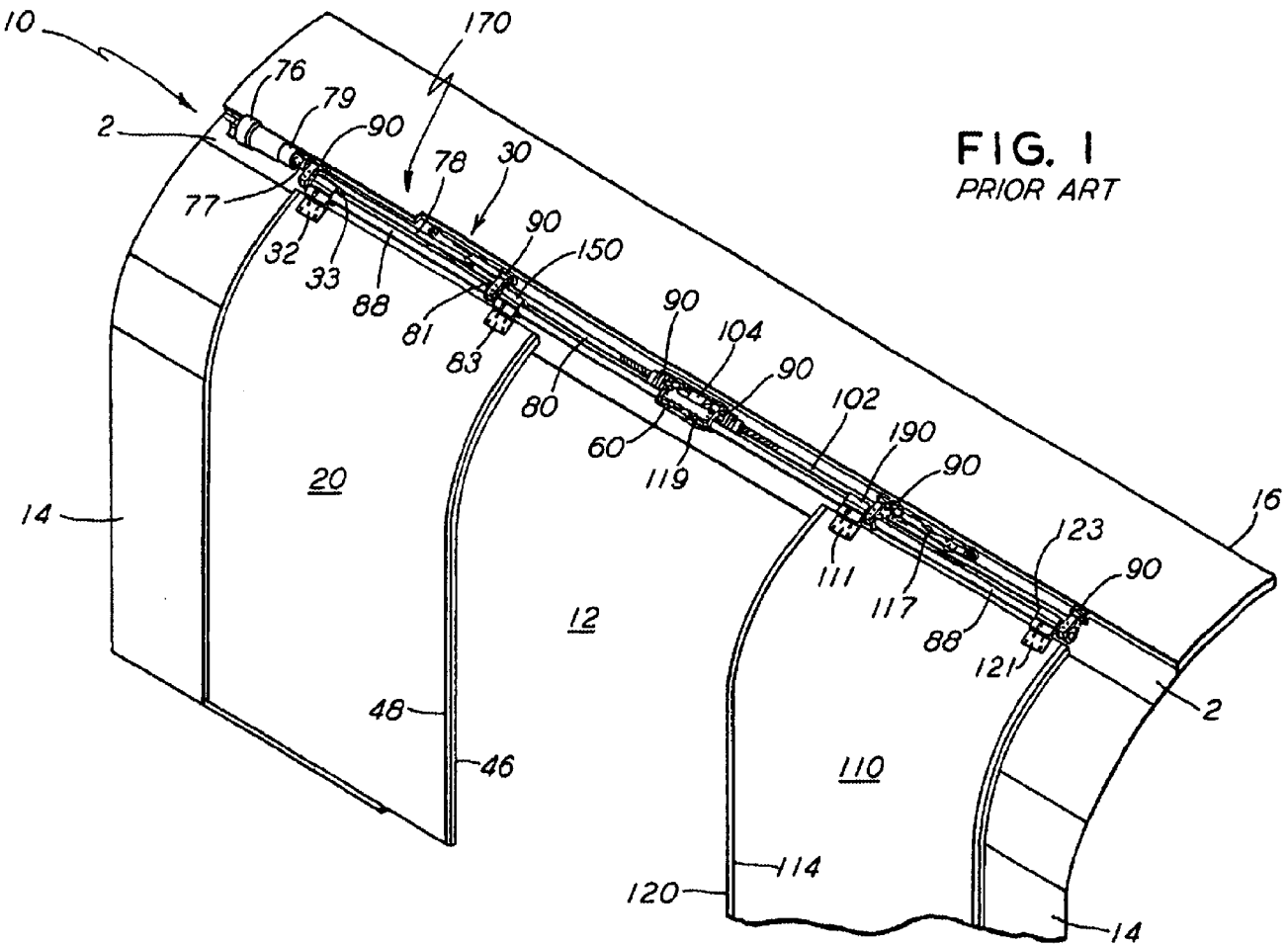
FIG. 1 PRIOR ART
FIG. 1 is a perspective view of one type of prior art door operator installed over a doorway whose doors are shown open.

DETAILED DESCRIPTION OF THE PRESENTLY PREFERRED AND VARIOUS ALTERNATIVE EMBODIMENTS OF THE INVENTION

Before describing the invention in detail, the reader is advised that, for the sake of clarity and understanding, identical components having identical functions have been marked where possible with the same reference numerals in each of the Figures provided in this document.

The following background information is provided to assist the reader to understand the environment in which the invention will typically be used. The terms used herein are not intended to be limited to any particular narrow interpretation unless specifically stated otherwise in this document.

Figure 2:
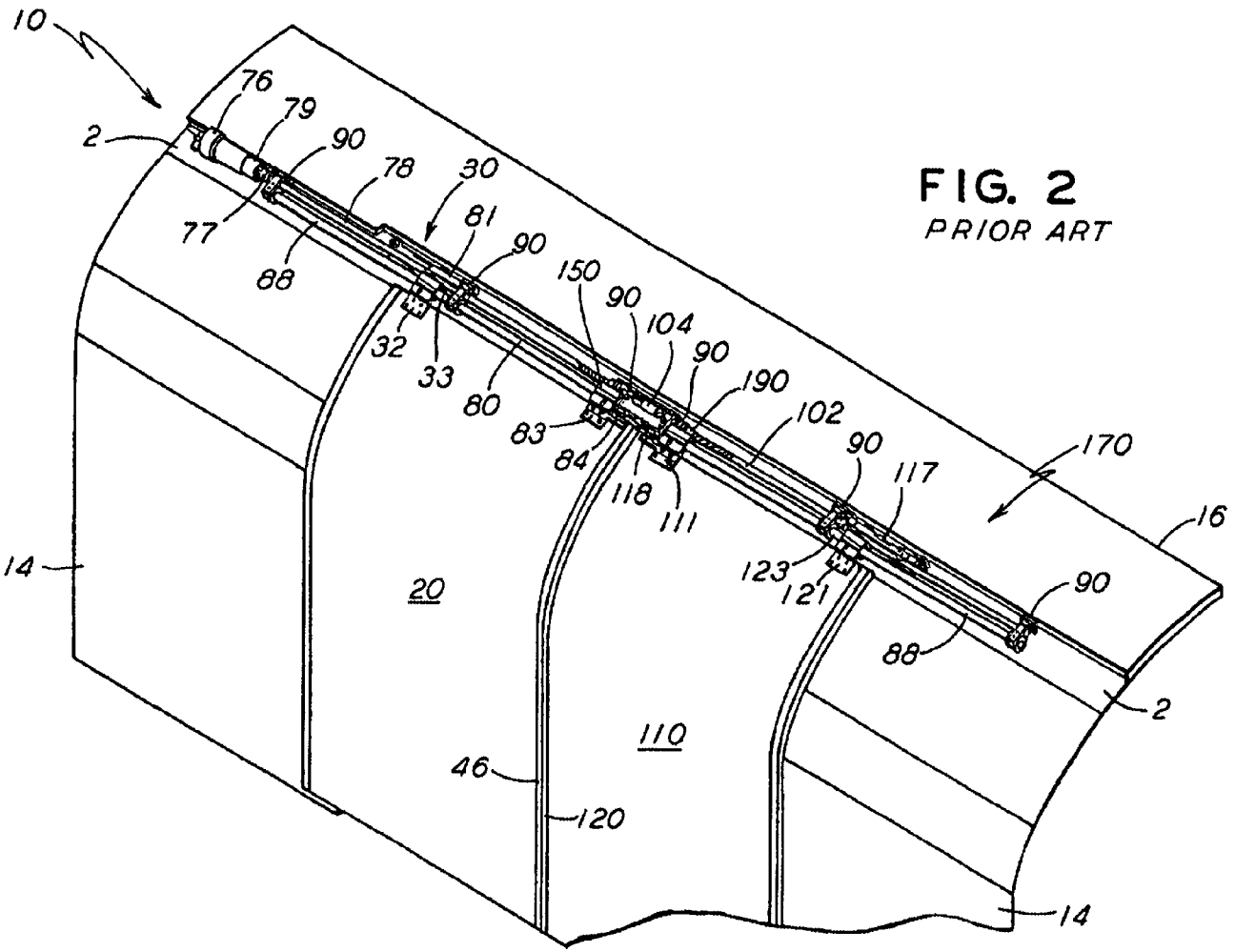
FIG. 2 PRIOR ART
FIG. 2 is a perspective view of the prior art door operator of FIG. 1 with the doors shown closed.

FIGS. 1 and 2 show a transit vehicle door system of a prior art type, generally designated 10, for covering and uncovering an aperture 12 for ingress and egress of passengers in a wall 14 of a transit vehicle 16. The door system 10 has a first door 20 mounted for movement in a first door closing direction 22 to a first door closed position at least partially covering aperture 12 and for movement in a first door opening direction 26 to a first door open position at least partially uncovering aperture 12, the first door opening direction 26 being opposite to the first door closing direction 22. The closed position is shown in FIG. 1 and the open position is shown in FIG. 2.

Door system 10 also has a second door 110 connected to the drive means 170 for longitudinal movement opposite to the first door 20, the second door 110 moving in a second door closing direction 112 to a second door closed position at least partially covering aperture 12 when first door 20 moves in the first door closing direction 22, and second door 110 moving in a second door opening direction 116 to a second door open position at least partially uncovering aperture 12 when first door 20 moves in the first door opening direction 26. The second door closing direction 112 is generally opposite to the first door closing direction 22 and the second door opening direction 116 is generally opposite to the first door opening direction 26. Hence, the first door 20 and the second door 110 cooperate to cover and uncover the aperture 12, as shown in FIGS. 1 and 2. Also, longitudinal acceleration loads and longitudinal gravity loads on the first door 20 are at least partially counterbalanced by longitudinal acceleration loads and longitudinal gravity loads on the second door 110, the longitudinal loads being communicated between the first door 20 and the second door 110 by a portion of the drive means 170 which includes center coupling 104. Drive means 170 includes coupling 77 which connects motor 76 to shaft 78, coupling 81 connecting shaft 78 to first screw 80, center coupling 104 connecting first screw 80 to second screw 102, nut assembly 150 for first door 20 and nut assembly 190 for the second door 110.

Door system 10 has a door biasing means, which preferably includes a seal, 46 attached to edge 48 of first door 20, as shown in FIG. 2. Door biasing means 46 is operable when the first door 20 is in the first door closed position and the second door 110 is in the second door closed position, the door biasing means 46 exerting a door biasing force tending to move the first door 20 in the first door opening direction 26 and to move the second door 110 in the second door opening direction 116, the door biasing force being communicated between the first door and the second door by the drive means 170. Preferably, a seal 120 is also attached to edge 114 of second door 110.

Figure 3:
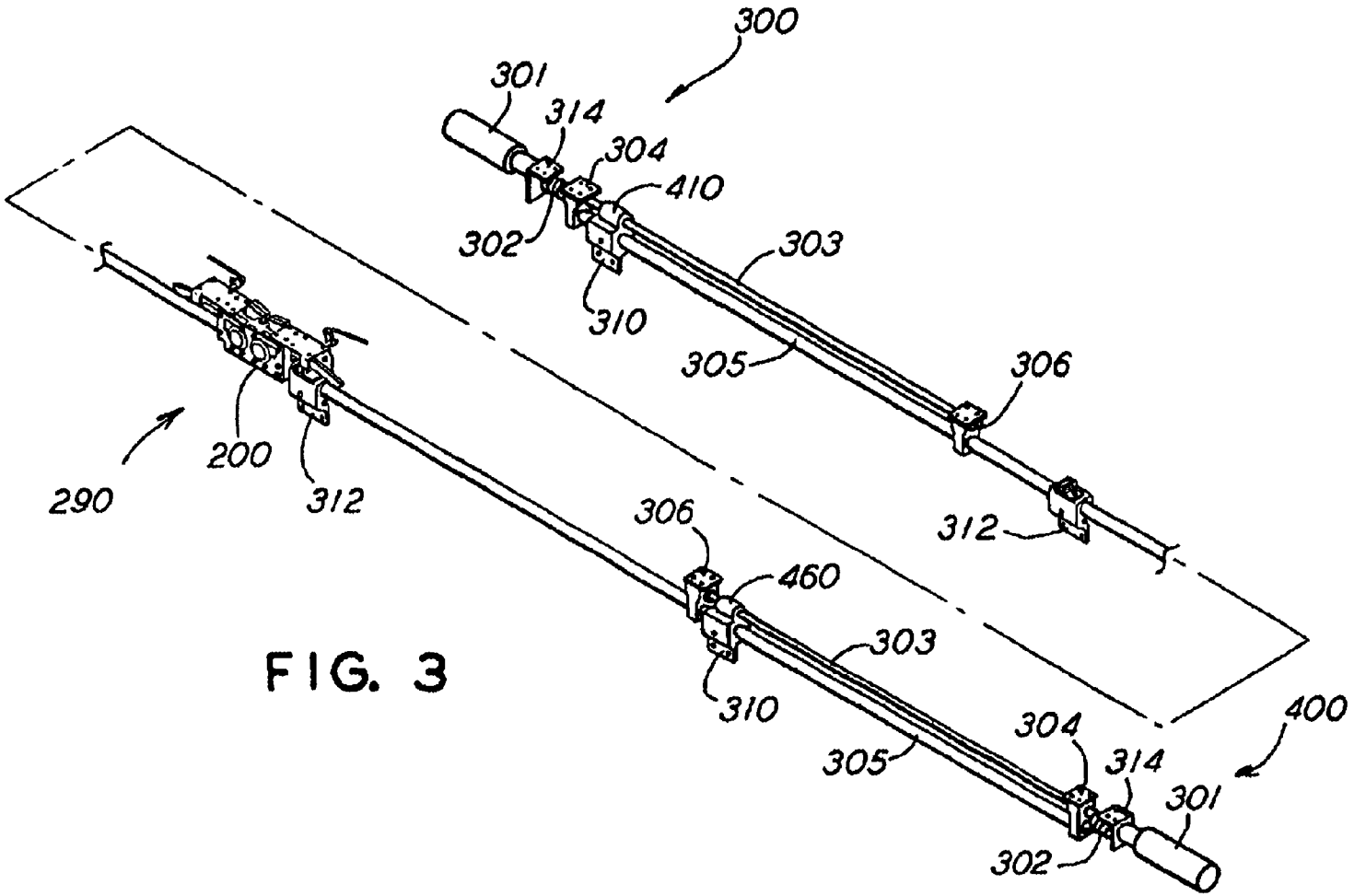
FIG. 3 is a perspective view of the central lock mechanism of a presently preferred embodiment of the present invention in combination with right hand and left hand door operators.
Figure 4A:
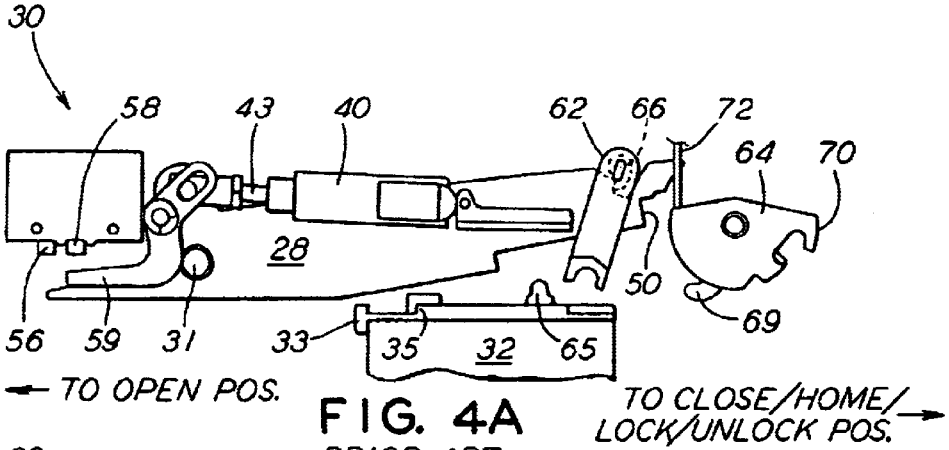
FIG. 4A PRIOR ART
FIGS. 4A–C are frontal views of the left door lock assembly of FIGS. 1–2 showing its lock member in the unlocked, pushback-locked and fully-locked states, respectively.
Figure 4B:
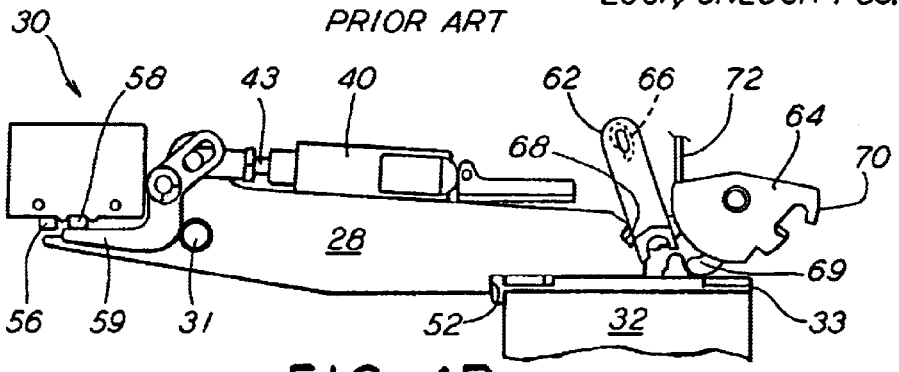
FIG. 4B PRIOR ART
Figure 4C:
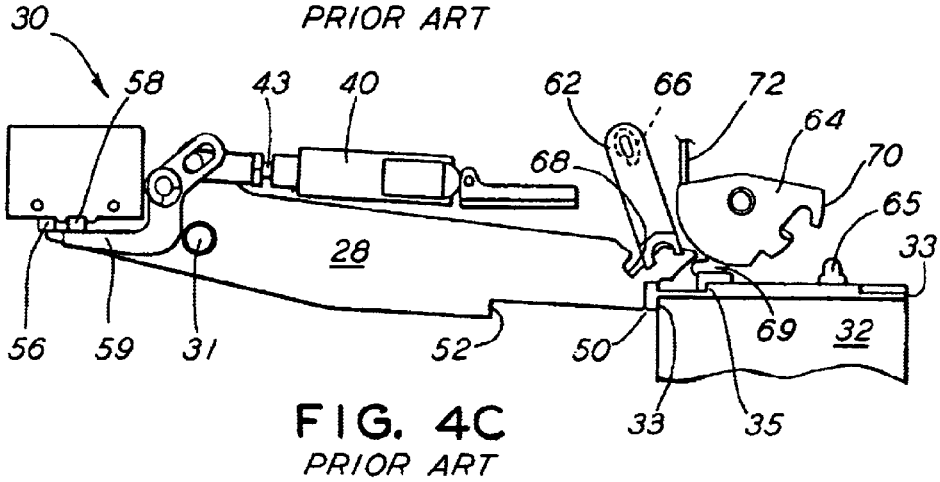
FIG. 4C PRIOR ART

FIG. 3 shows a door operator 290 as taught by a co-pending application entitled "Two Motor Arrangement for a Door Operator" filed with U.S. Patent Office concurrently herewith, such door operator 290 performing substantially similar functions as those performed by drive means 170 in FIGS. 1 and 2 to move doors 20 and 110 to cover and uncover an aperture 12.

Figure 6:
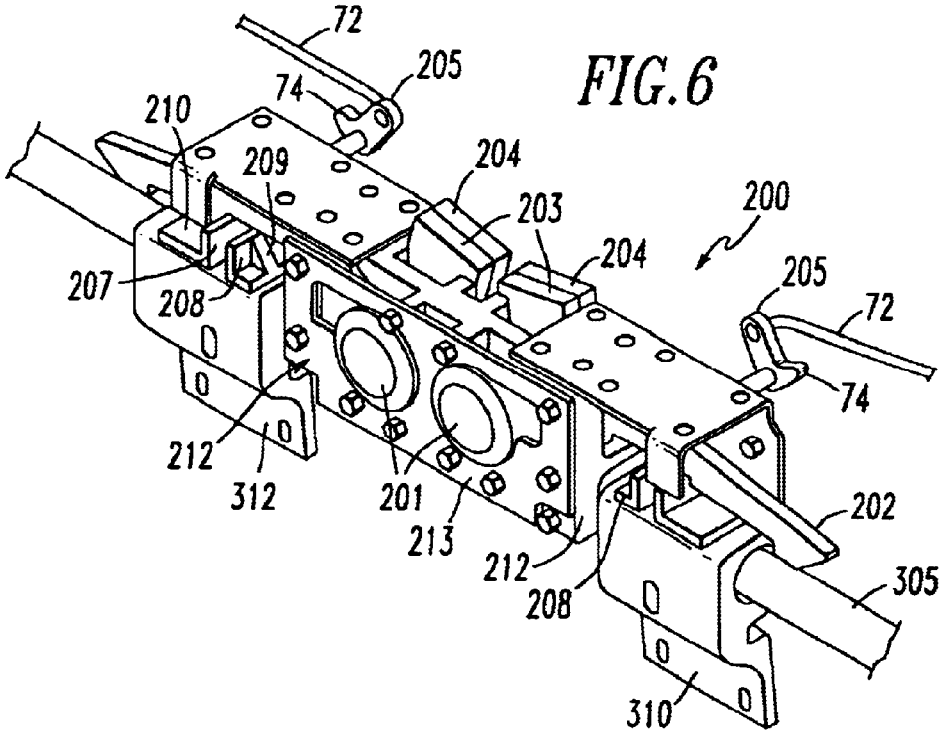
FIG. 6 is a perspective frontal view of a central lock mechanism shown in FIG. 3 according to the invention.
Figure 7:
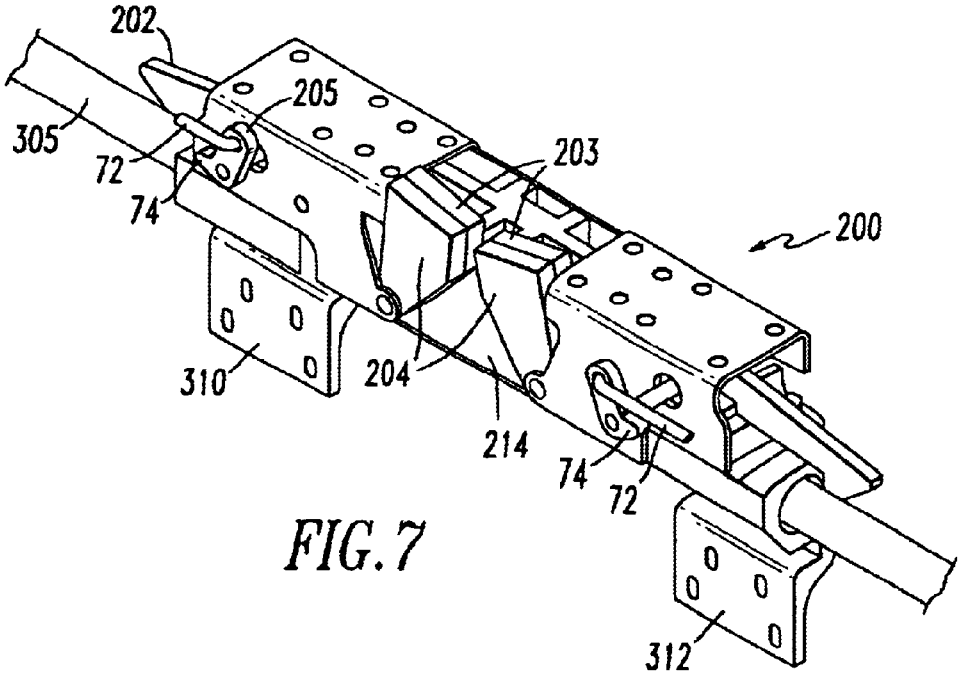
FIG. 7 is a perspective rear view of a central lock mechanism shown in FIG. 3 according to the invention.

Most overhead mounted door hardware systems, such as door system 10, are designed to open a pair of door panels. For this invention, a lock mechanism 200, best shown in FIGS. 3, 6, and 7, is substantially centrally disposed within the aperture 12 to lock door 20 and door 110 in a substantially closed position. Central lock mechanism 200 is most suitable with the door operator 290, therefore the following description of the door operator components will be done in reference with such door operator 290. However, those experienced in the art of door locks for passenger transit vehicles can easily see that the central door lock 200 can be easily integrated into a door system 10 of the prior art by modifying the connection between drive screws 80 and 102.

The lock mechanism 200 mechanically clamps together both door panels when they are in the door-closed position.

It includes two unlock rotary solenoids 201, two lock hooks 202, two door fully lock sensors 203, two pushback sensors 204, two emergency unlock mechanisms 205, two support block assemblies, generally designated 212, mounting bracket 213, and a cover 214. Alternatively, a single rotary actuator 201 may be configured with a suitable linkage to actuate both sides of the mechanism simultaneously.

Figure 8:
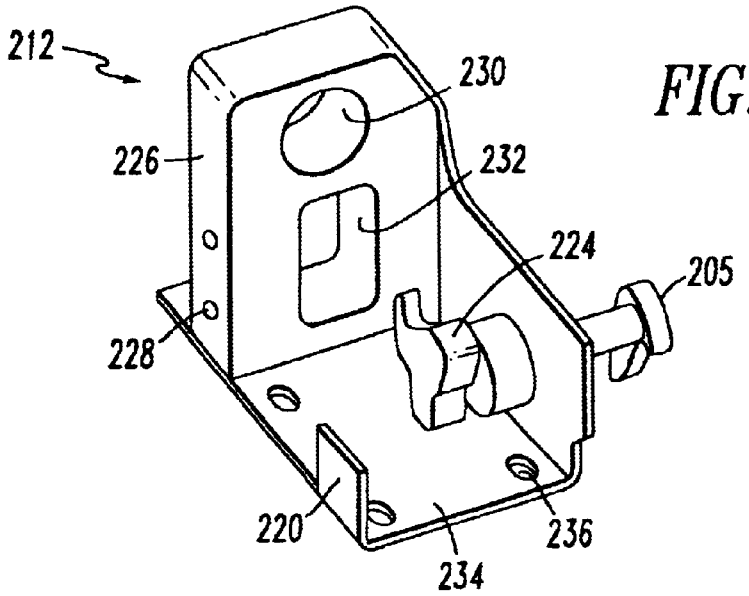
FIG. 8 is a perspective view of the left support block assembly of the central lock mechanism shown in FIGS. 6 and 7.
Figure 9:
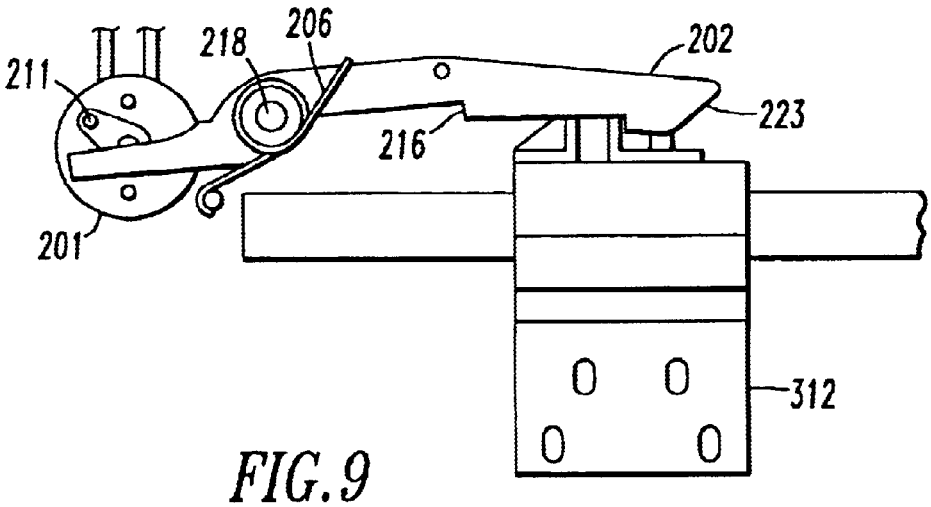
FIG. 9 is front view of the right door lock assembly of the central lock mechanism shown in FIGS. 6 and 7, showing its lock hook in the pushback-locked state.
Figure 10:
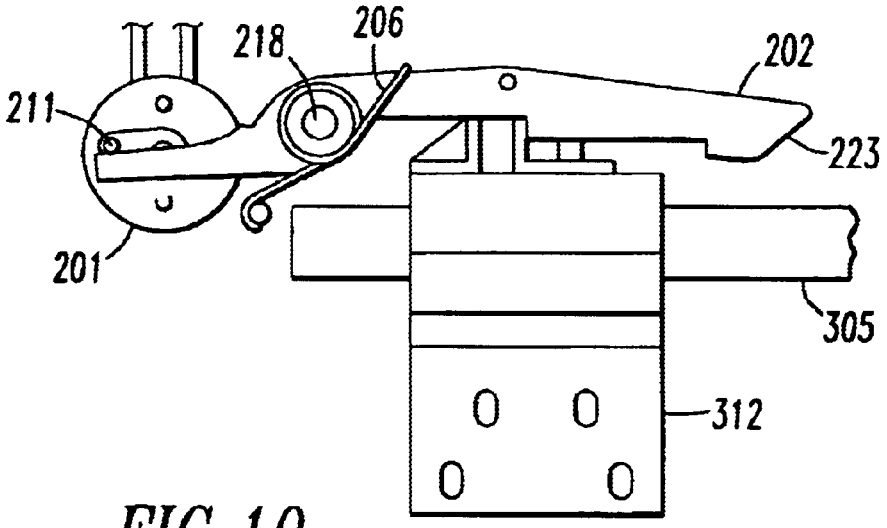
FIG. 10 is front view of the right door lock assembly, showing its lock hook in the fully-locked state.
Figure 11:
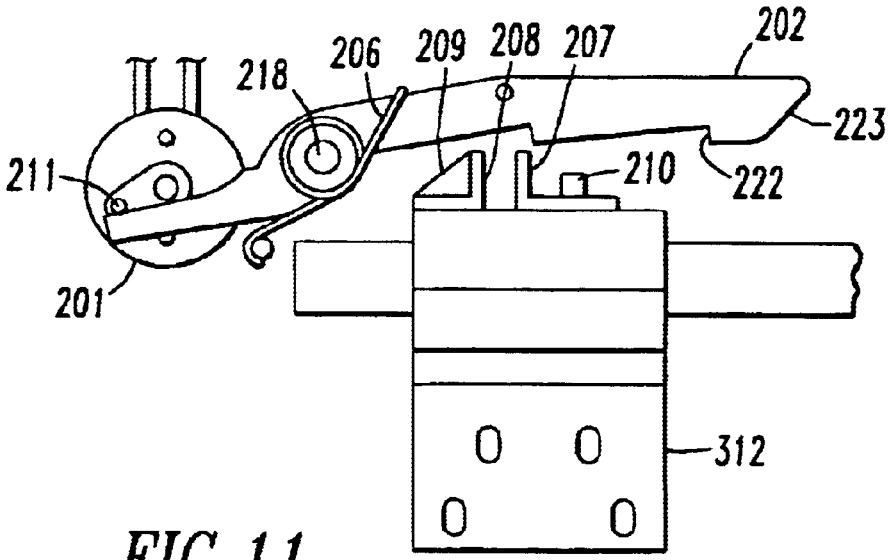
FIG. 11 is front view of the right door lock assembly, showing its rotary solenoid energized to lift its lock hook to the unlocked state.

Referring now to FIGS. 6 through 11, such door lock assembly 200 includes a first door lock member 202 for locking the first door 20 in the first door closed position, the first door lock member 202 being moveable to a first door locking position, shown in FIG. 10, in which it prevents opening of first door 20, and moveable to a first door unlocking position, as shown in FIG. 11, in which it does not prevent opening of the first door 20. The first door lock member 202 has a biasing force tending to move it towards the first door locking position.

The door lock assembly 200 has a first door unlocking actuator, which preferably is an electrical rotary solenoid actuator 201, as shown in FIGS. 6, 9, 10 and 11 for moving the first door lock member 202 from the first door locking position shown in FIG. 10 to the first door unlocking position shown in FIG. 11.

At least a portion of the door biasing force is reacted by the first door lock member 202 to generate a first door lock member load on the first door lock member 202, preventing movement of the first door lock member 202 from the first door locking position to the first door unlocking position when the motor 301 is not energized so that unlocking of the first door 20 requires, in addition to the first door unlocking signal to the first door unlocking actuator 201, a door closing signal to motor 301 to generate a first door closing force to overcome at least a portion of the door biasing force to remove at least a portion of the first door lock member load from the first door lock member 202 before the first door unlocking actuator 201 is able to move the first door lock member 202 from the first door locking position to the first door unlocking position whereby the door system 10 cannot be unlocked by a single spurious signal to either motor 301 or to the first door unlocking actuator 201.

In the presently preferred embodiment, as shown in FIG. 10 in the locking position, lock step 216 disposed within lock member 202, engages the mobile hook stopper 207 disposed within first door hanger 312. First door hanger 312 serves as a leading edge support for door 20. In the presently preferred embodiment, lock member 202 is rotatably connected to an off-center pivot 218 so that gravity biases it toward the locking position, as shown in FIGS. 9 and 10. Resilient bias means 206 disposed within the block support 212 are provided to further bias first door lock member 202 toward the locking position. In the preferred embodiment, as shown in FIGS. 9 and 10, such resilient bias means comprise a torsion spring 206 mounted around pivot 218 engaging the lock member 202 at one end and engaging tab 220 at the distal end as shown in FIG. 8. Spring 206 is mounted in torsional preload to bias lock member 202 toward the locking position as shown in FIGS. 9 and 10. Rotary actuator 201, when energized, causes cam 211 fitted on the output shaft of rotary actuator 201, to rotate and push directly at one end of door lock member 202 to lift door lock member 202 in the counter-clockwise direction to the unlocking position as shown in FIG. 11.

In further reference to FIG. 9, a mobile hook stopper 207 is pressed against pushback step 222 disposed within a lock member 202, such mobile hook stopper 207 is attached to the first door hanger 312 with a threaded fastener 210.

When the lock member 202 is in the pushback position, if a passenger has a body portion, a garment, or a possession caught by door 20, the passenger may move door 20 in the door opening direction 26 to a door pushback position established by step 222 of lock member 202 so that the passenger may extract the body portion, garment, or possession. When door 20 is in the door pushback position, aperture 12 is sufficiently covered that the passenger cannot pass through aperture 12.

FIG. 10 shows lock member 202, preferably, formed as an arm pivoted about pivot 218 and having a step 216 against which the mobile hook stopper 207 abuts when door 20 is in the fully closed position.

FIGS. 6 and 7 show the lock member pushback sensor 204, engageable by a cam 224 in the support block assembly 212 shown in FIG. 8, when lock member 202 is in the pushback position, as shown in FIG. 9. The cam 224 disposed within such support block assembly 212 further engages a pushback sensor 204 when lock member 202 is in the locked position, as shown in FIG. 10. In the presently preferred embodiment the pushback sensor 204 is a solid state limit switch. Alternatively, such pushback sensor 204 may be a proximity type. Furthermore, such pushback sensor 204 is connected to the control system (not shown) by a wiring connection (not shown) and provides a predetermined signal when the lock member 202 is in the pushback position.

FIGS. 6 and 7 further show a fully locked sensor 203. The fully locked sensor 203 is engaged by a portion of lock arm 202 when such lock arm 202 is in the fully locked position. Furthermore, the fully locked sensor 203 is connected to the control system (not shown) by a wiring connection (not shown) and provides a predetermined signal when the lock member 202 is in the fully locked position. In the presently preferred embodiment the fully locked sensor 203 is a solid state limit switch.

Alternatively, the fully lock sensor 203 may be a proximity type. Furthermore, in the preferred embodiment shown, sensor 203 is mounted adjacent sensor 204.

The support block assembly 212, as best shown in FIG. 8, comprises a first mounting portion 226 having a cavity 230 for attachment to drive rod 213 disposed within door operator 300. A cavity 232 for receiving lock member 202 and at least one threaded cavity 228 are attached to the mounting bracket 213. Such support block assembly 212 further includes a second mounting portion 234 connected to the first mounting portion 226 having at least one mounting cavity 236 for attachment to the passenger transit vehicle structure (not shown).

An emergency unlock lever 205 is rotatably mounted to the second mounting portion 234 for manual opening of the door 20 via a flexible tension member 72 attached to one end of such emergency unlock lever 205, as best shown in FIG. 6, or a lever 74, as best shown in FIG. 7. Such flexible tension member 72 may be, for example, a cord, a cable, a strap, a chain, etc.

A cam 224 engages the pushback limit switches 204 in each door lock assembly, such cam 224 is connected to the emergency unlock lever 205 at the distal end. To manually unlock door 20, such cam 224 rotates the lock member 202 in a counterclockwise direction to fully unlock the door 20. The cam 224 further engages the mobile hook stopper 207 to move the mobile hook stopper 207 in the right hand direction and, more particularly, move the door 20 toward the opening direction to partially uncover the aperture 12 by a predetermined distance of 20 mm. This is done so that a passenger can see that the door system 10 is unlocked and obtain a grip to move door 20 sufficiently for egress from the transit vehicle 16.

Door panel stopping means 220 are disposed within the second mounting portion 234 for substantially preventing door panel movement in case of door operator 290 failure. In the presently preferred embodiment such door panel stopping means 220 is a formed portion substantially perpendicular to the second mounting portion 234. Alternatively, the door panel stopping means 220 may comprise a resilient rubber stop attached to the second mounting portion 234 with threaded fasteners.

In the door open position, the lock member 202, remains normally exposed, biased in a downward orientation about its pivot 218 by gravity and the torsional biasing spring member 206. During door closing, the ramped surface 209 disposed within a fixed hook stopper 208 mounted to hanger 32 engages the uniquely shaped leading end 223 disposed within lock member 202 producing a force on the pivot lock member in the counterclockwise direction allowing it to clear the mobile hook stopper 207 further mounted to such hanger 32 allowing engagement with lock member notch 222 soon thereafter. Generally, prior art systems have included one or more additional components to affect the orientation and timing of rotation of similar lock members during the closing and locking cycle to achieve the described engagement with similar locking surfaces or entities.

In the presently preferred embodiment, the mirror symmetrical parts of central door lock mechanism 200 include a second door lock member 202, as shown in FIGS. 6 and 7, for securing the second door 110 in the closed position. Also included with the second door lock member 202 is a second door unlocking actuator 201 which is connected to the control system (not shown) via a connection (not shown). A second support block assembly 212, a second fully locked sensor and a second pushback sensor 204 are provided. Preferably, the second door lock member 202 is biased toward a second door locking position, as shown in FIG. 10, in which it presses against the mobile hook stopper 207 of hanger 121 of door 110 and thereby prevents opening of such second door 110. Second door lock member 202 is also moveable by the second door unlocking actuator 201 to a second door unlocking position, shown in FIG. 11, in which it allows opening of second door 110.

It is preferred that at least a portion of the door biasing force be reacted by the second door lock member 202 to generate a second door lock member load on the second door lock member 202. The second door lock member load preventing movement of the second door lock member 202 from the second door locking position to the second door unlocking position when the motor 301 is not energized so that unlocking of the second door 110 requires, in addition to the second door unlocking signal to the second door unlocking actuator 201, a door closing signal to the motor 301 to generate a second door closing force to overcome at least a portion of the door biasing force to remove at least a portion of the second door lock member load from the second door lock member 202 before the second door unlocking actuator 201 is able to move the second door lock member 202 from the second door locking position to the second door unlocking position. Hence, the first door lock member and the second door lock member 202 provide redundant locking of the first door 20 and the second door 110.

In the presently preferred embodiment, the second door lock member 202 has a second lock member pushback position 222, shown in FIG. 9, so that if one of the passengers has a bodily portion, a garment, or another object caught by the second door 110, the passenger may move the second door 110 in the second door opening direction 116 to a second door pushback position established by the second door lock member 202 so that the passenger may extract the body portion, garment, or other object. The aperture 12 being sufficiently covered in the second door pushback position so that the passenger cannot pass through aperture 12 when the second door is in the second door pushback position.

A second emergency release, similar to emergency release mechanism 205 should be provided for emergency release of the second lock member 202. Such second emergency release rotor should be activated simultaneously with the first emergency release mechanism 205. For example, each may have a flexible tension member 72, with both being activated by the same handle.

During the door 20 or door 110 movement toward the closed position the lock member 202 drops into the first pushback stage lock upon the door 20 or 110 reaching the pushback zone of approximately 57.5 mm from substantially fully closed position. The pushback limit switch 204 is actuated to confirm this status, as shown in FIG. 9.

As the door 20 or 110 continues to close to an almost fully closed position the door 20 or 110 cannot be reopen either manually or with power beyond the pushback zone because of the first stage lock portion 222 engaging a mobile stopper hook 207.

Upon reaching a substantially fully closed position a seal 46 compresses against the mating door seal 120. The lock member 202 drops into the second stage lock having a second stage lock portion 216 engaging a mobile stopper hook 207, as shown in FIG. 10. The door fully lock limit switch 203 is actuated to provide this status. Once the second stage lock is engaged, the power to the door motor is removed but some door seal compression remains due to the lock members 202.

At the beginning of the opening stroke the door open signal from the door controller (not shown) first forces the door 20 and door 110 to move toward the closing direction further compressing the door seals 46 and 120. This closing movement removes completely the preload on the lock member 202 due to mobile stopper hook 207 mounted on the leading edge of the linear bearing housing. Once this preload is removed, the unlock solenoid 201 is energized disengaging the lock member 202, as shown in FIG. 11. Once the door 20 or 110 has opened beyond the pushback zone, the power to the unlock solenoid 201 is removed allowing the lock member 202 to drop due to gravity.

The central lock mechanism 200 incorporates several features. It is designed to operate as two completely independent locks within a single lock assembly per double door opening. Therefore, in the event of a failure, the affected door 20 or 110 can be isolated and the mating door 110 or 20 will keep operating normally. Passengers can still ingress and egress through aperture 12 but at a reduced flow.

In door fully closed position, the lock mechanism 200 keeps the door leading edge seals 46 and 120 compressed mechanically. This serves three main purposes. First, as a hazard prevention feature, it prevents the lock members 202 from unlocking unless the door controller (not shown) first compresses the door seals even further. This means that, even if a failure causes the unlock solenoid 201 to energize, it will not unlock the door 20 or 110 unless the door controller initially compresses even more the door seals 46 and 120. Second, it reduces to a maximum the noise in the passenger transit vehicle 16 and the door vibration during moving.

The door lock assemblies in the central lock mechanism 200 are each capable of operating as a two-stage lock, i.e., providing pushback-locked and fully-locked states. The unique shape of the lock members 202, having a pushback step 222 and a lock step 216 allows the doors to be mechanically locked into two distinct areas: (1) the door pushback zone; and (2) the door fully closed position.

When locked in the pushback zone, each door 20 and 110 cannot be opened by more than 57.5 mm, even if there is a power failure or electrical problem with the door operator 290 or door controller (not shown). Thus, a passenger transit vehicle can safely leave a station with doors 20 and 110 locked in pushback zone. The advantage for a passenger transit vehicle to leave a station with the doors 20 and 110 locked in push back zone is two fold. First, when the passenger transit vehicle is leaving a station, if a passenger is caught between the door panels, the passenger will be able to free himself by opening each door by up to 57.5 mm. This door movement will be sensed and the passenger transit vehicle driver/monitoring system (not shown) will be advised. Without this feature, if the door locked in a fully closed position, the passenger could remain caught between the door panels, and conceivably even be dragged by the train. Second, the pushback zone is large enough for a passenger to free herself or himself (or a purse or bag) but not large enough for the passenger to fall through the door opening.

The central lock mechanism 200 also provides an automatic locking feature. To unlock the door 20 and 110, the unlock solenoids 201 must be energized. When such solenoids 201 are deenergized, the lock members 202 automatically move downward into door lock position by the force of gravity (i.e., the center of gravity forces lock members to drop into lock position) and by a torsion spring 206.

The central lock mechanism 200 requires only two adjustments as compared to prior art door lock assemblies. The first adjustment is for the door 20 or 110, specifically for centering and due to dimensional tolerances of doors 20 and 110, door seals 46 and 120 and of various components of the overhead door mechanism 290. This adjustment can be simply done by loosening fastener 210 and moving mobile support 207 to a predetermined position.

The second adjustment is to assure that the sensors 203 and 204 actuate timely and is done, wherein the sensors 203 and 204 can be adjusted simultaneously.

The central lock mechanism 200 has fewer components than typical prior art door lock assemblies employing a linear type electric or pneumatic actuator. The mechanism was purposefully designed to have as few components as possible. To do so, items had to be designed with multiple functions in mind. For example, the support block assemblies 212 serve many purposes. Each assembly 212 supports one door panel through the linear shaft 213, and also provides the pivot mounting point for one of the lock hooks 202. The support block assembly 212 also serves as the mount for the solenoid 201 and switches 203 and 204. It also supports the emergency unlock lever 205 and holds the wire harness for the electrical components of the central lock mechanism 200. It also acts as a stopper for the door panel in case of a failure of the drive mechanism. Each support block assembly 212 also supports a cam for the actuation of the pushback limit switches 204 in each door lock assembly. Furthermore, a rotary solenoid 201 is connected to the lock member 202 with cam 211.

The central lock mechanism 200 has also been designed to be tamper resistant. Because the lock mechanism 200 is centrally located above the doorway 12, when the doors 200 and 110 are fully opened, a passenger could try to vandalize the lock assemblies. To reduce the likelihood of such tampering, the lock mechanism 200 has been design with the following features. First, a cover 214 with limited openings shields the central portion of lock mechanism 200 not only to prevent dirt from accumulating inside the mechanism 200 but also to prevent tampering with the mechanism 200. Second, in the sections of the mechanism 200 that cannot be physically protected by a cover, the exposed components have been made of materials of predetermined strength to resist tampering. Third, the fixed hook stopper 208 of each lock assembly has a ramp 209 that lifts its corresponding lock member 202 when the doors are closing. The lock hooks 202, which are exposed when the doors are open, normally are biased downward when the doors 20 and 110 are open. As the doors close, the ramp 209 on each stopper 208 lifts its corresponding lock member 202, which then engages automatically soon thereafter. Therefore, even if someone tampers with a lock member 202 (e.g., holds it down or up), the operation of the doors will not be affected.

While a presently preferred and various additional alternative embodiments of the instant invention have been described in detail above in accordance the patent statutes, it should be recognized that various other modifications and adaptations of the invention may be made by those persons who are skilled in the relevant art without departing from either the spirit of the invention or the scope of the appended claims.

I claim:

1. A lock mechanism engageable with a first door hanger bracket disposed within a first door operator of a passenger transit vehicle, said lock mechanism further engageable with a first door bracket disposed within a second door operator of such passenger transit vehicle, said lock mechanism disposed intermediate said first door operator and said second door operator substantially centrally adjacent an aperture in a wall of such passenger vehicle for passenger egress and ingress, said lock mechanism comprising:

(a) a first support assembly mounted to such passenger transit vehicle;

(b) a second support assembly mounted to such passenger transit vehicle, said second support assembly disposed substantially symmetrical to said first support assembly;

(c) a mounting bracket attached at a first end thereof to said first support assembly and to said second support assembly at a distal end thereof;

(d) a first and second rotary actuator attached to said mounting bracket;

(e) a first lock member disposed within said first support assembly, said first lock member connected to said first rotary actuator at one end, said first lock member engaging a door bracket disposed within a first door at a distal end;

(f) a second lock member disposed within said second support assembly, said second lock member connected to said second rotary actuator at one end, said second lock member engaging a door bracket disposed within a second door at a distal end;

(g) a means attached to said first support assembly for manually opening said first door;

(h) a means attached to said second support assembly for manually opening said second door;

(i) a means disposed within said lock mechanism for providing at least one predetermined electrical status signal; and (j) a cover connected to said first support assembly at one end and to said second support assembly at a distal end, said cover substantially shielding said rotary actuators from access upon at least partial uncovering of said aperture.

2. A lock mechanism according to claim 1, wherein each of said first support assembly and said second support assembly further includes:

(a) a first mounting portion;

(b) a second mounting portion attached to said first mounting portion;

(c) a cavity disposed within said first mounting portion for engagement with a drive rod disposed within said door operator;

(d) a cavity disposed within said first mounting portion for engagement with said lock member;

(e) at least one cavity disposed within said second mounting portion for attachment to a structural member of such passenger vehicle; and (f) a door stopping means disposed within said second mounting portion for substantially preventing door movement in case of a door operator failure.

3. A lock mechanism according to claim 2, wherein said door stopping means includes a formed portion substantially perpendicular to said second mounting portion.

4. A lock mechanism according to claim 2, wherein said door stopping means includes a resilient rubber stop attached to said second mounting portion.

5. A lock mechanism according to claim 1, wherein said means attached to said support assembly for manually opening said door includes:

(a) an unlock lever rotatably connected to said support assembly;

(b) a flexible cable connected to said unlock lever for rotating said unlock lever, said flexible cable being operable by a person from a remote location; and (c) a cam mounted to said unlock lever, said cam engageable with said lock member to rotate said lock member from a lock position into a first unlock position, said cam further engageble with a bracket disposed within said door to move said door by a predetermined distance toward an open direction to uncover a portion of such aperture so that a person can see that said door system is unlocked and obtain a grip to open said door system sufficiently for egress from such transit vehicle.

6. A lock mechanism according to claim 1, wherein said means disposed within said lock mechanism for providing at least one predetermined electrical status signal includes:

(a) a first lock sensor for providing a predetermined status signal when said first lock member is in a substantially locked position;

(b) a first pushback sensor for providing a predetermined status signal when said first lock member is in a pushback lock position;

(c) a second lock sensor for providing a predetermined status signal when said second lock member is in a substantially locked position; and (d) a second pushback sensor for providing a predetermined status signal when said second lock member is in a pushback lock position.

7. A lock mechanism according to claim 6, wherein said sensors are a solid state type limit switch.

8. A lock mechanism according to claim 6, wherein said sensors are a proximity type sensor.

9. A lock mechanism according to claim 6, wherein said first unlock sensor and said first pushback sensor are mounted substantially adjacent each other so that both sensors can be adjusted simultaneously and said second unlock sensor and said second pushback sensor are mounted substantially adjacent each other so that both sensors can be adjusted simultaneously.

10. A lock mechanism according to claim 1, wherein said lock member is mounted so that gravity tends to move it into said locking position so that at least a portion of said first door lock member biasing force is due to gravity.

11. A lock mechanism according to claim 1, wherein said door system further includes a resilient bias means exerting a force on said first door lock member in a locking direction of said first door lock member so that at least a portion of said first lock member biasing force is provided by said resilient member.

12. A lock mechanism according to claim 11, wherein said resilient bias means is a torsion spring engaging said lock member at one end, said torsion spring engaging said support assembly at a distal end.

13. A lock mechanism according to claim 1, wherein said door lock member has a lock member pushback position disposed between a pushback step and a lock step which provides for manual door movement in an opening direction to establish an aperture for withdrawing a human body portion, a garment, or another object captured by said door system while preventing passage of an entire human body through such aperture.

14. A lock mechanism according to claim 1, wherein said rotary actuator is an electric solenoid having a simple cam mounted at one end, said cam engaging a lock member, so that when said rotary actuator is energized, said cam rotates to move said lock member from said locking position to said first unlocking position.

* * * * *